US005320386A

United States Patent [19]

Harmala et al.

[11] Patent Number: 5,320,386

[45] Date of Patent: Jun. 14, 1994

[54] COMPOSITE TITANIUM SKI POLE AND METHOD OF MAKING SAME

[75] Inventors: John Harmala, Saline; Jodi Peterson, Ludington, both of Mich.

[73] Assignee: Halvati Sport Limited, Saline, Mich.

[21] Appl. No.: 35,318

[22] Filed: Mar. 22, 1993

[51] Int. Cl.[5] ..... A63C 11/22

[52] U.S. Cl. ..... 280/819

[58] Field of Search ..... 280/819, 820, 823, 824; 428/615, 34.1, 468

[56] References Cited

U.S. PATENT DOCUMENTS

| | | | |
|---|---|---|---|
| 2,031,384 | 2/1936 | Oliver | 280/819 |
| 2,123,311 | 7/1938 | Muller-Roggli | 280/819 X |
| 3,972,529 | 8/1976 | McNeil | 280/819 X |
| 4,301,201 | 11/1981 | Stout | 280/819 X |
| 5,024,866 | 6/1991 | Goode | 280/819 X |

FOREIGN PATENT DOCUMENTS

| | | | |
|---|---|---|---|
| 2605581 | 8/1976 | Fed. Rep. of Germany | 280/819 |
| 117835 | 9/1969 | Norway | 280/819 |
| 197318 | 7/1938 | Switzerland | 280/819 |
| 229442 | 10/1943 | Switzerland | 280/819 |

*Primary Examiner*—Richard M. Camby
*Assistant Examiner*—Michael Mar
*Attorney, Agent, or Firm*—Harness, Dickey & Pierce

[57] ABSTRACT

A ski pole having a composite shaft. The composite shaft of the present invention includes a hollow first shaft of titanium alloy and a hollow second shaft of stiffening material. The first and second shafts are mounted to one another with an exterior surface of one of the shafts in surface-to-surface contact with an interior surface of the other of the shafts. The ski pole also includes a tip mounted to the lower end of the composite shaft, a basket mounted adjacent to said tip, and a hand grip mounted on said upper end of the composite shaft.

17 Claims, 1 Drawing Sheet

COMPOSITE TITANIUM SKI POLE AND METHOD OF MAKING SAME

BACKGROUND AND SUMMARY OF THE INVENTION

The present invention generally relates to ski poles and in particular to ski poles having composite titanium shafts.

Conventional ski poles are generally comprised of a hollow tapered shaft made up of aluminum or other light weight metal. A hand grip is mounted to one end of the shaft, typically a non-tapered end, while a basket and tip are mounted to the other or tapered end of the shaft. The tip is constructed from an impact resistant material, such as metal. This prevents the shaft from incurring damage when struck against a hard surface, such as a rock, during skiing. The basket is mounted to shaft generally adjacent to the tip and is configured to prevent the ski pole from descending into the snow during use.

A significant limitation of the aluminum ski pole is that it is easily damaged during normal skiing activities. Being relatively soft, aluminum ski poles are notorious for becoming permanently deformed and breaking as a result of the bending loads encountered during skiing. Another limitation of aluminum ski poles is that they have a low resistance to abrasion and are easily cut or scratched. The cuts are often the result of the ski pole shaft abrasively contacting various surfaces, such as icy snow conditions, during use. While being light in weight, the limitations of aluminum ski poles with respect to durability and deformation resistance has made it desirable for designers to try and advance in ski pole technology.

In recent years, alternatives to the conventional aluminum shafted ski pole have captured the favor of a large portion of the skiing population. Numerous producers have introduced ski poles in which the shafts are composites of synthetic resins and filaments. While being more resilient under bending forces than aluminum, these known composite ski poles continue to lack sufficient strength and still experience failure at an unacceptable rate. Additionally, during regular skiing activities, filament-type ski poles represent a significant hazard to the skier's hand or other body portions and can break since they shatter exposing splinters. Even without completely breaking in half, splinters can be exposed near the surface of the pole as a result of bending loads causing the pole to crack and the filaments to separate. While offering some structural advances over aluminum shafted ski poles, the known ski poles having composite shafts still exhibit some safety limitations.

Accordingly, it is an object of this invention to provide a composite ski pole that offers improvements in terms of safety and structure while overcoming the limitations of the prior art. The present invention therefore has as some of its objects, provision of a ski pole which is lightweight, resistant to abrasion, resistant to permanent deformation and does not splinter when cracked or completely broken.

In general appearance, the composite ski pole of this invention is similar to prior ski poles in that it includes a shaft having a hand grip, a tip, and a basket mounted to it. The shaft itself has a composite construction which includes a thin-walled tube made of a titanium alloy. The titanium alloy tube is reinforced with an inner or stiffening tube. As more fully discussed below, this stiffening tube can be made from a variety of alternative materials. In one embodiment, the exterior diameter of the stiffening tube substantially corresponds with the inner diameter of the titanium alloy tube and the stiffening tube is inserted into the titanium alloy tube so that its exterior surface will be in intimate surface-to-surface contact with the inner surface of the titanium alloy tube. While it is believed that a press-fitted engagement between the titanium alloy and stiffening tubes is sufficient to keep the tube secured together, an adhesive or other bonding agent can be used to more positively bond the tubes together.

In an additional embodiment of the invention, a core element, such as foam, is positioned within the inner cavity of the stiffening tube. The core serves to dampen vibration in the shaft, further stiffens the shaft, and also enables increases the shaft's resistance to crushing.

When provided as briefly described above, the titanium alloy tube provides the shaft of the ski pole with its lightweight and high strength characteristics. While being quite rigid, the titanium alloy tube still exhibits a significantly high yield point that enables it to deflect under substantial bending loads without becoming permanently deformed. By employing the stiffening tube in conjunction with the titanium alloy tube, the titanium alloy tube is still permitted to bend, but is substantially prohibited from bending in an amount which would approach its yield point and result in permanent deformation.

According to another aspect of this invention, a method for manufacturing the titanium composite ski pole of the present invention includes the steps of first providing a hollow tube of titanium alloy and then providing a hollow tube of stiffening material. The tube of stiffening material is inserted into the titanium alloy tube with the exterior surface of the stiffening tube being in intimate surface-to-surface contact with the interior surface of the titanium alloy tube. As mentioned above, an adhesive may be applied between the two tubes to positively bond the tubes together. After the stiffening tube and titanium alloy tubes have been mounted together, the tubes are cut to an appropriate length for the ski pole shaft. An impact resistant tip is then mounted to one end of the ski pole shaft while a hand grip is mounted to the opposing end. Adjacent to the tip, the basket is secured to the ski pole shaft.

As seen from the summary presented above, the ski pole of this invention is lightweight, generally rigid and offers high performance characteristics. The composite construction of the shaft of this ski pole prohibits the shaft from being loaded beyond its yield point in all but the most extreme bending conditions. This results in the present invention being highly resistant to permanent deformation and collapse. The titanium exterior of the present invention further offers a high degree of resistance to abrasion and increases the durability of the ski pole. Additionally, the ski pole of the present invention will endure a substantial amount of deflection without any resulting splintering and thereby offers safety advances over prior ski pole construction.

While the above description constitutes the preferred embodiments of the present invention, it will be appreciated that the invention is susceptible to modification, variation and change without departing from the proper scope and fair meaning of the accompanying claims.

DETAILED DESCRIPTION OF THE PREFERRED EMBODIMENTS

Figure 1:
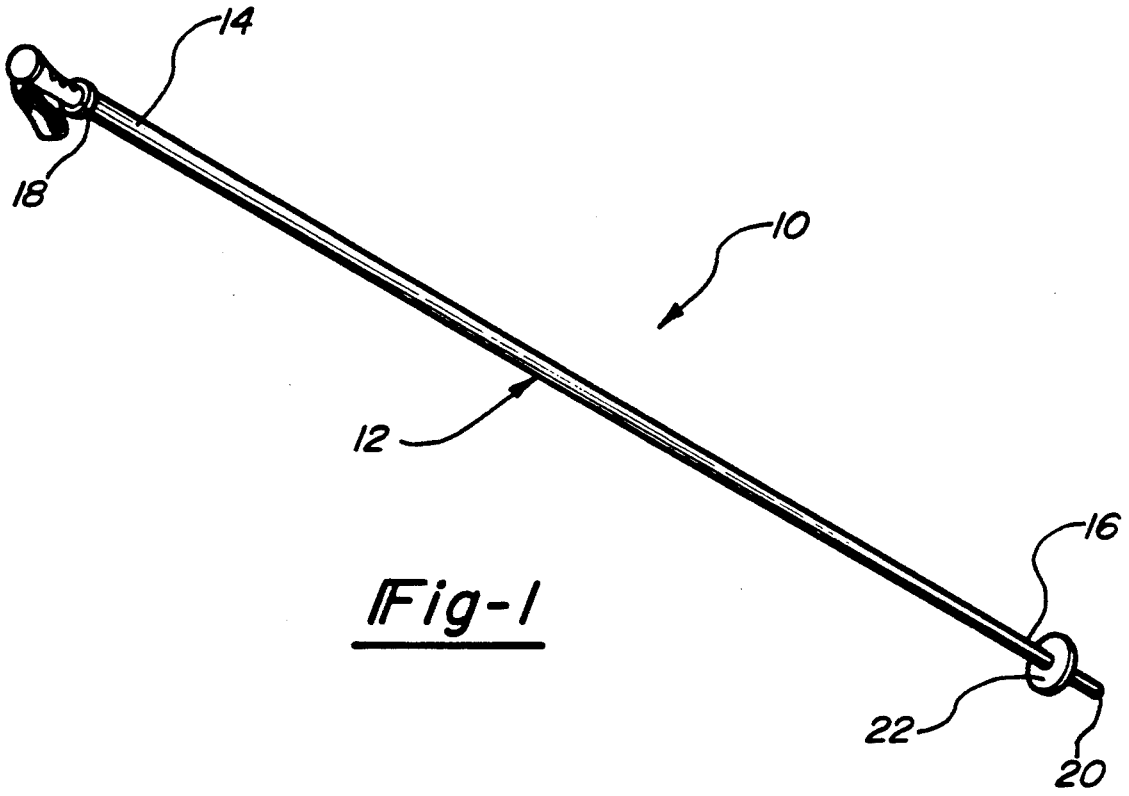
FIG. 1 is a perspective view of a ski pole embodying the principles of the present invention.

Referring now to the drawing, a ski pole embodying the principles of the present invention is generally illustrated in FIG. 1 and designated at 10. In its finished construction, the principal components of the ski pole 10 include a shaft 12, a hand grip 18, a tip 20 and a basket 22.

The shaft 12 includes an upper end 14 and a lower end 16. The hand grip 18 is either adhesively fictionally mounted to the upper end 14 of the shaft 12. Various conventional methods can be used to mount the tip 20 to the lower end 16 of the shaft 12 including press-fitting the tip 20 into the shaft 12, adhesively bonding the tip 20 with the shaft 12, or securing the tip 20 in the shaft 12 through a threaded engagement, either with or without an insert in the lower end 16 of the shaft 12.

The basket 22 is mounted onto the shaft 12 at a location which is generally adjacent to the lower end 16 and the tip 20. To enable mounting of the basket 22, the basket 22 is typically provided with an annular opening (not designated) in its center which permits the basket 22 to be slipped onto and secured to the exterior surface of the shaft 12. Typically the basket 22 is adhesively secured to the shaft 12. However, other conventional securing methods can also be used. The structure of the basket 22 limits the depth with which the ski pole 10 can be inserted into the snow during skiing. As such, the basket 22 may be constructed with a full skirt as seen in FIG. 1 or with a number of radial webs interconnected by a perimeter ring.

In general designing a ski pole, it is important to remember that, since the ski pole will be carried by a skier who is traveling downhill at a high rate of speed, the ski pole can become a source of potential harm should the skier lose balance and experience a fall. With this in mind, a ski pole should be designed so that it will deflect and behave in a predictable manner. If its behavior can be controlled, the ski pole can be rendered more safe in those situations where the skier inadvertently thrusts the pole into a hard object or where the skier "catches" an end of the pole in his body.

When loaded in compression along its longitudinal axis, ski poles are therefore designed to experience a limited degree of bending. The ski pole 10 of the present invention is provided with a construction that is capable of exhibiting a significant amount of deflection without becoming permanently bent or collapsing. Rather, the ski pole 10 of this invention is constructed so that during deflection it is substantially prevented from reaching its yield point and becoming permanently set as a result of bending loads encountered during normal skiing conditions, including situation where the skier falls or is thrust onto the ski pole.

In providing the ski pole 10 with the above-mentioned attributes, the present invention seeks to avoid the use of filaments which might result in splinters along the shaft 12 of the pole, which would themselves constitute a hazard to the skier.

Figure 2:
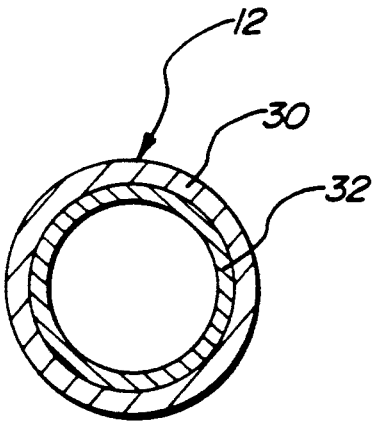
FIG. 2 is a cross-sectional view taken substantially along line 2—2 in FIG. 1 showing the construction of a ski pole shaft embodying the principles of the present invention.

A cross-sectional view of one embodiment of a shaft 12 utilized in a ski pole 10 of the present invention is illustrated in FIG. 2. The shaft 12 has a composite construction and includes an outer shaft or tube 30 and an inner shaft or tube 32. The outer shaft is constructed from a titanium alloy because of its superior strength, lightweight, abrasion resistance, and its ability to bend to a significant extend without becoming permanently set. Preferably, the titanium alloy is Ti-3Al-2.5V. However, depending upon the specific characteristics desired in the ski pole 10, alternate titanium alloys can be used. The outer shaft also preferably has a constant outer diameter of approximately 0.405 inches and is constructed as a seamless, extruded tube with a constant thickness. However, it is anticipated that the present invention could also be utilized where the outer shaft 30 includes a seam, is not formed by extrusion, or where the outer shaft 30 tapers to a reduced diameter at its lower end 16.

Immediately inward of the outer shaft 30 is the inner shaft 32. The inner shaft 32 has an exterior diameter which substantially corresponds to the inner diameter of the outer shaft 30. This enables the inner shaft to be precision fit, in a press fit manner, inside of the outer shaft 30. Alternatively, an adhesive may be applied to the exterior surface of the inner shaft 32 so as to bond it to the interior surface of the outer shaft 30.

Preferably, the inner shaft 32 exhibits a constant thickness throughout its length and extends substantially the entire length of the outer shaft 30. While the inner shaft 32 extends the length of the outer shaft 30 in the preferred embodiment, both its length and thickness can be varied to provide the ski pole 10 with a wide variety of performance characteristics. The inner shaft 32 is constructed from carbon fiber, plastic or another material which will operate to increase the stiffness of the titanium alloy outer shaft 30 and substantially limit the outer shaft 30 from being loaded and bent beyond its yield point causing the outer shaft 30 to develop a permanent set. In this manner, the ski pole 10 of this invention is capable of absorbing significant bending loads during a fall without becoming permanently bent or without causing significant injury to the skier because of it being too stiff. The ability of the present invention is to offer substantial amount of flexibility and resistance to permanent deformation during a fall, coupled with its rigidity and performance characteristics during normal use, creates a balanced ski pole 10 which is neither too stiff not too flexible.

Figure 3:
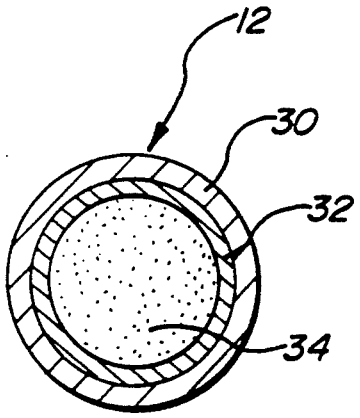
FIG. 3 is a cross-sectional view, similar to that seen in FIG. 2, which illustrates another embodiment of the present invention.

In one alternative embodiment illustrated, FIG. 3, the outer and inner shafts 30 and 32 are provided substantially as mentioned above. However, the hollow interior cavity of the inner shaft 32 is filled with a filler or core 34. The core 34 is preferably one of the numerous varieties of the foam and may actually be foamed in place. The filler 34 dampens the ski pole 10 and reduces vibrations which may be transferred to the skier through the ski pole 10. The core 34 also increases the stiffness of the shaft 12 while enhancing its crush resistance. Specific performance criteria for the ski pole 10 will dictate whether the filler 34 is provided throughout the entire length of the shaft 12, only along part of its length or not at all.

Various techniques and methods can be used to construct the ski pole 10 of this invention. One such method would involve extruding or otherwise providing a length of the outer shaft 30 and subsequently press-fitting a length of the inner shaft 32 within it. Prior to inserting the inner shaft 32, the exterior of the inner shaft or the interior of the outer shaft could be coated with an adhesive as mentioned above. Once the outer and inner shafts 30 and 32 have been mounted together, the shaft 12 may be filled with the filler 34, if desired, and cut to length. The length of the shaft 12 will vary depending upon the height of the skier with which it is intended to be used. The hand grips 18, tip 20 and basket 22 are then mounted to the shaft 12.

In an alternative construction technique, the inner shaft 32 may be formed by an extrusion process while the outer shaft is simultaneously extruded thereover. The filler 34, if desired, is provided into the inner shaft 32 and the shaft 12 is cut to length.

Prior to the mounting of the hand grip 18, basket 22 and tip 20, the shaft 12 may be provided with details improving its aesthetic appearance. As such, the shaft 12 may be painted or otherwise provided with a protective coating, and graphics may be applied. Alternatively, pigments or dyes can be provided in the titanium alloy and the outer shaft 30 formed with an inherent color.

As described above, the present invention details a ski pole 10 having a composite shaft 12 that is highly resilient, yet provides a significant degree of rigidity, and whose construction can be varied so as to alter performance characteristics with respect to flexibility, stiffness, strength, weight, and aesthetics.

While the above description constitutes the preferred embodiments of the present invention, it will be appreciated that the invention is susceptible to modification, variation and change without departing from the proper scope and fair meaning of the accompanying claims.

What is claimed is:

1. A lightweight, high strength ski pole comprising a composite shaft having upper and lower ends, said composite shaft including a hollow all metal first shaft having a substantially smooth exterior surface and being formed of titanium alloy, said first shaft having a first length, said composite shaft also including a hollow second shaft of carbon fiber material having a second length, said first and second shafts being mounted to one another with an exterior surface of said second shaft in surface-to-surface contact with an interior surface of said first shaft, said second shaft thereby cooperating with said first shaft to provide said ski pole with a predetermined amount of flexural strength, a tip mounted on said lower end of said composite shaft, a basket mounted on said composite shaft generally adjacent to said tip at said lower end, and a hand grip mounted on said upper end of said composite shaft.

2. A ski pole according to claim 1, wherein said first shaft is a seamless tube of extruded titanium alloy.

3. A ski pole according to claim 1, wherein said first and second shafts have substantially constant wall thicknesses.

4. A ski pole according to claim 1, wherein said first and second shafts are substantially annular in transverse cross section.

5. A ski pole according to claim 1 wherein said first and second shafts are mounted together by a press fit mounting.

6. A ski pole according to claim 1 wherein said first shaft has constant exterior diameter.

7. A ski pole according to claim 1 wherein said composite shaft has an exterior diameter of about 0.405 inches.

8. A ski pole according to claim 1 wherein said titanium alloy is Ti-3Al-2.5V.

9. A ski pole according to claim 1 wherein said first and second lengths are approximately the same.

10. A ski pole according to claim 1 wherein said first length is greater than said second length.

11. A ski pole according to claim 1 wherein said first shaft has a thickness which is less than a thickness of said second shaft.

12. A ski pole according to claim 1 wherein said second shaft has a thickness which is less than a thickness of said first shaft.

13. A ski pole according to claim 1 wherein said first shaft has a thickness substantially the same as a thickness of said second shaft.

14. A lightweight, high strength ski pole comprising a composite shaft including a hollow all metal first shaft having a substantially smooth exterior surface and being formed of titanium alloy, a hollow second shaft of carbon fiber, said second shaft being positioned within said first shaft with an exterior surface of said second shaft in surface-to-surface contact with an interior surface of said first shaft, said second shaft cooperating with said first shaft to provide said ski pole with a predetermined amount of flexural strength, a core of filler material located within said second shaft and partially filling said second shaft to dampen said ski pole and provide a solid feel while adding weight to said ski pole and increasing crush resistance, said composite shaft further having an upper end and a lower end, a tip mounted to said lower end, a basket mounted on said composite shaft generally adjacent to said lower end, and a hand grip mounted to said upper end.

15. A ski pole according to claim 14 wherein said filler material is foam.

16. A ski pole according to claim 14 wherein said core substantially completely fills said second shaft.

17. A ski pole according to claim 14 wherein said titanium alloy is Ti-3Al-2.5V.

* * * * *